US007278702B2

(12) United States Patent
Silverbrook

(10) Patent No.: US 7,278,702 B2
(45) Date of Patent: Oct. 9, 2007

(54) SPEEDSTICK PLUGIN AND REPROGRAMMABLE MODULES, CONTROLLERS AND COMPONENTS

(75) Inventor: Kia Silverbrook, Balmain (AU)

(73) Assignee: Silverbrook Research Pty Ltd, Balmian, New South Wales (AU)

( * ) Notice: Subject to any disclaimer, the term of this patent is extended or adjusted under 35 U.S.C. 154(b) by 175 days.

(21) Appl. No.: 10/503,890

(22) PCT Filed: Feb. 12, 2003

(86) PCT No.: PCT/AU03/00148

§ 371 (c)(1),
(2), (4) Date: Aug. 9, 2004

(87) PCT Pub. No.: WO03/068517

PCT Pub. Date: Aug. 21, 2003

(65) Prior Publication Data

US 2005/0151774 A1 Jul. 14, 2005

(30) Foreign Application Priority Data

Feb. 13, 2002 (AU) ..... PS 0481

(51) Int. Cl.
*B41J 29/393* (2006.01)
*B41J 29/38* (2006.01)

(52) U.S. Cl. ..... 347/19; 347/9

(58) Field of Classification Search ..... 347/19, 347/9

See application file for complete search history.

(56) References Cited

U.S. PATENT DOCUMENTS 5,802,420 A * 9/1998 Garr et al. ..... 347/19
5,929,875 A 7/1999 Su et al.
5,966,159 A * 10/1999 Ogasawara ..... 355/41
6,312,075 B1 11/2001 Walker
6,361,139 B1 3/2002 Gomez et al.
6,550,881 B1 * 4/2003 Phillips ..... 347/19
2002/0045519 A1 * 4/2002 Watterson et al. ..... 482/54

(Continued)

FOREIGN PATENT DOCUMENTS

EP 665675 A2 8/1995

(Continued)

OTHER PUBLICATIONS

Derwent Abstract Accession No. 2001-012015/02, classes P75, T04, JP 2000289235 A (Seiko Epson Corp) Oct. 17, 2000.

(Continued)

*Primary Examiner*—Matthew Luu
*Assistant Examiner*—Jannelle M Lebron

(57) ABSTRACT

A printer or photocopier operable at a plurality of different performance levels. A metering system measures usage of the device in units of use, and is configured such that the number of units metered for performing a particular task of the device is varied in reliance on a level of performance of the device for that task. In one form, the device includes a user interface for receiving user input indicative of a selected level of performance, the metering system being configured to utilize the selected level of performance in metering the usage. Alternatively, or in addition, the metering system is configured to determine the actual level of performance of the device and to utilize the actual level of performance in metering the usage. System components may be user replaceable modules.

6 Claims, 7 Drawing Sheets

U.S. PATENT DOCUMENTS

| | | | |
|---|---|---|---|
| 2002/0075344 | A1 | 6/2002 | Usui et al. |
| 2002/0130910 | A1* | 9/2002 | Otsuki ..... 347/5 |

FOREIGN PATENT DOCUMENTS

| | | | |
|---|---|---|---|
| EP | 720343 | A2 | 7/1996 |
| EP | 1231058 | A2 | 8/2002 |
| GB | 2267195 | A | 11/1993 |
| GB | 2360491 | A | 9/2001 |

OTHER PUBLICATIONS

Derwent Abstract Accession No. 1999-351745/30, classes P75, T04, JP 11129498 A (Seiko Epson Corp) May 18, 1999.

Derwent Abstract Accession No. 1999-351745/30, classes P75, T04, JP 11129498 A (Seiko Epson Corp) May 18, 1999.

Derwent Abstract Accession No. 2002-043815.06, classes P75, T04, JP 2001102935 A (Seiko Epson Corp) Apr. 13, 2001.

Derwent Abstract Accession No. 97-105129/10, classes T01, T04, JP 8339281 A (Canon KK) Dec. 24, 1996.

Derwent Abstract Accession No. 1999-6143911/53, classes P75, S06, JP 11268306 A (Brother Kogyo KK) Oct. 5, 1996.

* cited by examiner

SPEEDSTICK PLUGIN AND REPROGRAMMABLE MODULES, CONTROLLERS AND COMPONENTS

CROSS REFERENCES TO RELATED APPLICATIONS

The present application is a 371 of PCT/AU03/00148 filed on Feb. 12, 2003.

FIELD OF INVENTION

The present invention relates to devices for which metering of usage is implemented.

The invention has been particularly developed for use with printers and photocopiers, and will be described hereinafter with reference to these specific applications. However, it will be appreciated by those skilled in the art that the invention can be embodied in many other forms.

BACKGROUND TO INVENTION

With many products the price to the consumer is linked to its performance. For example a printer having a particular resolution or print speed generally costs less to buy than a printer having a higher resolution or print speed, all other things being the same. This is usually because the cost to the manufacturer of providing the better performance is greater than the cost of providing the lower performance. For example, a high resolution ink jet printer may have more nozzles in the printhead or more accurate control compared to a low resolution device; a high resolution laser printer may use toner having finer particles than a low resolution device. Current inkjet printers (most photocopiers are electro-photographic, and do not scan) utilize at least one device that scans or reciprocates across the width or length of the paper being printed or copied. This reciprocating motion generally places limits on the speed of printing or copying.

The current applicants have developed page width printheads that allow ink jet printing of a page to occur by moving a page past a fixed printhead. This removes one printing speed limitation and can increase the base level of performance. The speed of printing is then limited by factors such as speed of paper feed, the speed of the printer's electronics and the speed of the printhead itself.

There are many factors that limit the performance of a printer. An initial assumption is that all components of a device are designed for the particular performance of that device. However for a family of products this will result in many similar components. The savings of designing the components for each model may well be outweighed by the need to carry a much larger inventory, and other associated costs. As such a single component shared across a family of products may result in the lowest overall cost to the manufacturer. Where a single component is shared across a family of products, by necessity, it must be designed for the 'high-end' product. Accordingly it is under utilized in the 'low-end' products. Where only some components are shared across a family of devices the performance of the low end products may be limited by one or more other components that represent "bottle necks" in performance. Alternatively, the performance of the device may be artificially restricted. Performance may be artificially restricted even when one or more components limit performance.

CO-PENDING APPLICATIONS

Various methods, systems and apparatus relating to the present invention are disclosed in the following co-pending applications filed by the applicant or assignee of the present invention simultaneously with the present application:

| | | |
|---|---|---|
| PCT/AU03/00150 | PCT/AU03/00154 | PCT/AU03/00151 |
| PCT/AU03/00152 | PCT/AU03/00145 | PCT/AU03/00153 |
| PCT/AU03/00170 | PCT/AU03/00168 | PCT/AU03/00169 |
| PCT/AU03/00146 | PCT/AU03/00159 | PCT/AU03/00162 |
| PCT/AU03/00149 | PCT/AU03/00167 | PCT/AU03/00171 |
| PCT/AU03/00147 | PCT/AU03/00166 | PCT/AU03/00158 |
| PCT/AU03/00163 | PCT/AU03/00165 | PCT/AU03/00164 |
| PCT/AU03/00157 | PCT/AU03/00148 | PCT/AU03/00160 |
| PCT/AU03/00155 | | PCT/AU03/00156 |

The disclosures of these co-pending applications are incorporated herein by cross-reference.

RELATED PATENT APPLICATIONS AND PATENTS

| | | | | |
|---|---|---|---|---|
| 6566858 | 6331946 | 6246970 | 6442525 | PCT/AU01/00141 |
| 09/505951 | PCT/AU01/00139 | 6816968 | 6757832 | PCT/AU01/00140 |
| PCT/AU00/00741 | 6238044 | PCT/AU00/00742 | 6425661 | 6227652 |
| 6213588 | 6213589 | 6231163 | 6247795 | 6394581 |
| 6244691 | 6257704 | 6416168 | 6220694 | 6257705 |
| 6247794 | 6234610 | 6247793 | 6264306 | 6241342 |
| 6247792 | 6264307 | 6254220 | 6234611 | 6302528 |
| 6283582 | 6239821 | 6338547 | 6247796 | 6557977 |
| 6390603 | 6362843 | 6293653 | 6312107 | 6227653 |
| 6234609 | 6238040 | 6188415 | 6227654 | 6209989 |
| 6247791 | 6336710 | 6217153 | 6416167 | 6243113 |
| 6283581 | 6247790 | 6260953 | 6267469 | 6273544 |
| 6309048 | 6420196 | 6443558 | 6439689 | 6378989 |
| 6848181 | 6634735 | PCT/AU98/00550 | PCT/AU00/00095 | 6390605 |
| 6322195 | 6612110 | 6480089 | 6460778 | 6305788 |
| PCT/AU00/00172 | 6426014 | PCT/AU00/00338 | 6364453 | PCT/AU00/00339 |
| 6457795 | PCT/AU00/00581 | 6315399 | PCT/AU00/00580 | 6338548 |
| PCT/AU00/00582 | 6540319 | PCT/AU00/00587 | 6328431 | PCT/AU00/00588 |
| 6328425 | PCT/AU00/00589 | 6991320 | PCT/AU00/00341 | 6595624 |
| PCT/AU00/00340 | PCT/AU00/00749 | 6417757 | PCT/AU01/01332 | 7095309 |
| PCT/AU01/01318 | 6854825 | PCT/AU00/00750 | 7075677 | PCT/AU00/00751 |
| 6428139 | PCT/AU00/00752 | 6575549 | PCT/AU01/00502 | PCT/AU00/00583 |

-continued

| RELATED PATENT APPLICATIONS AND PATENTS | | | | |
|---|---|---|---|---|
| 6383833 | PCT/AU02/01120 | PCT/AU00/00593 | 6464332 | PCT/AU00/00333 |
| PCT/AU00/01513 | 6428142 | PCT/AU00/00590 | 6390591 | PCT/AU00/00591 |
| 7018016 | PCT/AU00/00592 | 6328417 | PCT/AU00/00584 | 6322194 |
| PCT/AU00/00585 | 6382779 | PCT/AU00/00586 | 6629745 | PCT/AU00/01514 |
| 6565193 | PCT/AU00/01515 | 6609786 | PCT/AU00/01516 | 6609787 |
| PCT/AU00/01517 | 6439908 | PCT/AU00/01512 | 6684503 | PCT/AU00/00753 |
| 6755513 | PCT/AU00/00594 | 6409323 | PCT/AU00/00595 | 6281912 |
| PCT/AU00/00596 | 6604810 | PCT/AU00/00597 | 6318920 | PCT/AU00/00598 |
| 6488422 | PCT/AU01/01321 | 6655786 | PCT/AU01/01322 | 6457810 |
| PCT/AU01/01323 | 6485135 | PCT/AU00/00516 | 6795215 | PCT/AU00/00517 |
| 09/575109 | PCT/AU00/00511 | 6859289 | PCT/AU00/00754 | 6977751 |
| PCT/AU00/00755 | 6398332 | PCT/AU00/00756 | 6394573 | PCT/AU00/00757 |
| 6622923 | | | | |

SUMMARY OF INVENTION

In accordance with a first aspect of the invention, there is provided a device operable at a plurality of different performance levels, the device including a metering system configured to measure usage of the device in units of use, configured such that the number of units metered for performing a particular task of the device is varied in reliance on a level of performance of the device for that task.

In one form, the device includes a user interface for receiving user input indicative of a selected level of performance, the metering system being configured to utilize the selected level of performance in metering the usage. Alternatively, or in addition, the metering system is configured to determine the actual level of performance of the device and to utilize the actual level of performance in metering the usage.

The usage metering system can include a single usage meter, or a plurality of usage meters. In the latter case, it is possible to include a base performance usage meter configured to meter usage for a given task independently of the selected or actual performance level. Alternatively, there is a separate usage meter for each performance level, in which case it is preferred that the usage meter corresponding to the actual or selected performance level is only incremented when the device is selected to or operates at the corresponding performance level.

In accordance with a second aspect of the invention, there is provided method of metering usage of a device operable at a plurality of performance levels, the method including the steps of:

determining a level of performance of the device;

metering usage of the device, wherein the number of units metered for performing a particular task of the device is varied in reliance on a level of performance of the device for that task.

Preferably, the method further includes the step of receiving user input indicative of a selected level of performance. The metering system is then configured to utilize the selected level of performance in metering the usage.

In an alternative embodiment, the method further includes the step of determining an actual level of performance of the device, and using the determined actual level performance in metering the usage.

In either aspect, the performance level includes at least one of copy speed, print speed, resolution or color resolution.

DETAILED DESCRIPTION OF PREFERRED EMBODIMENT

Figure 1:
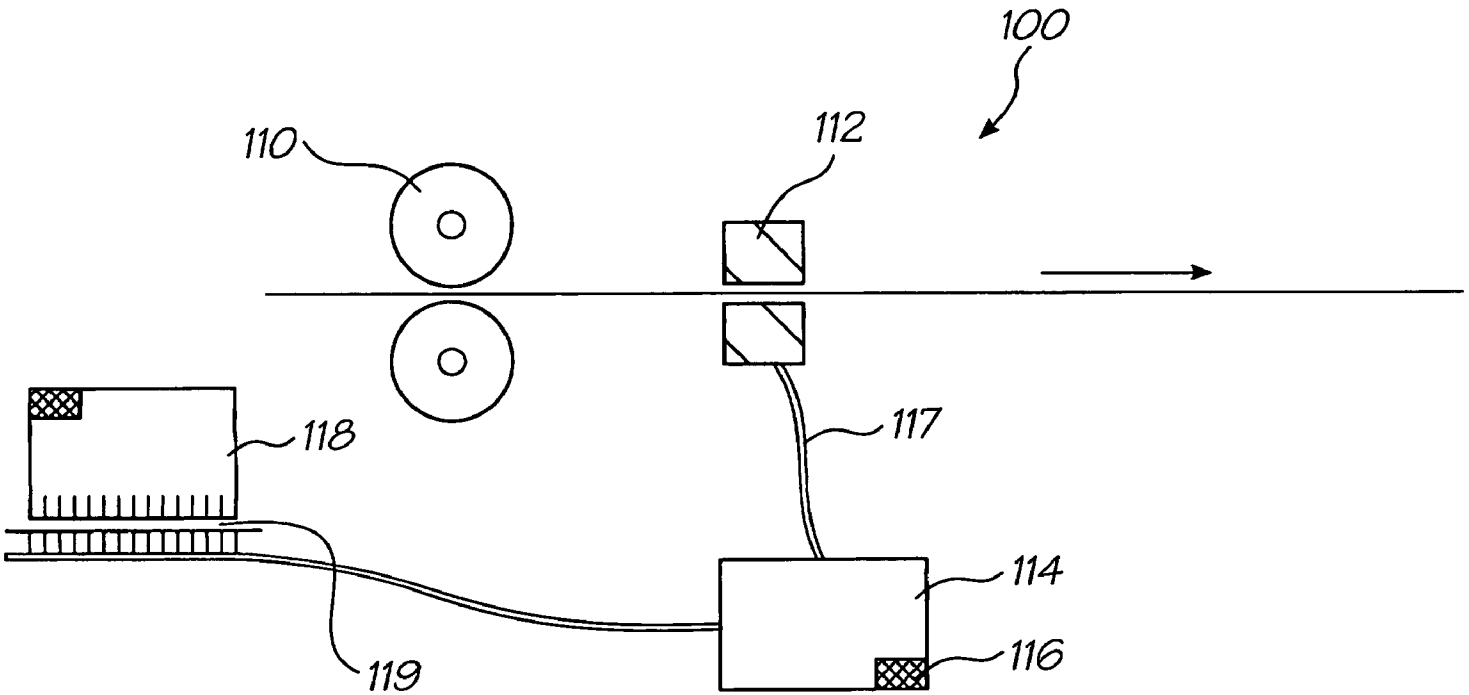
FIG. 1 schematically shows a cross section though an ink jet type printer, showing some of the mechanical components.
Figure 2:
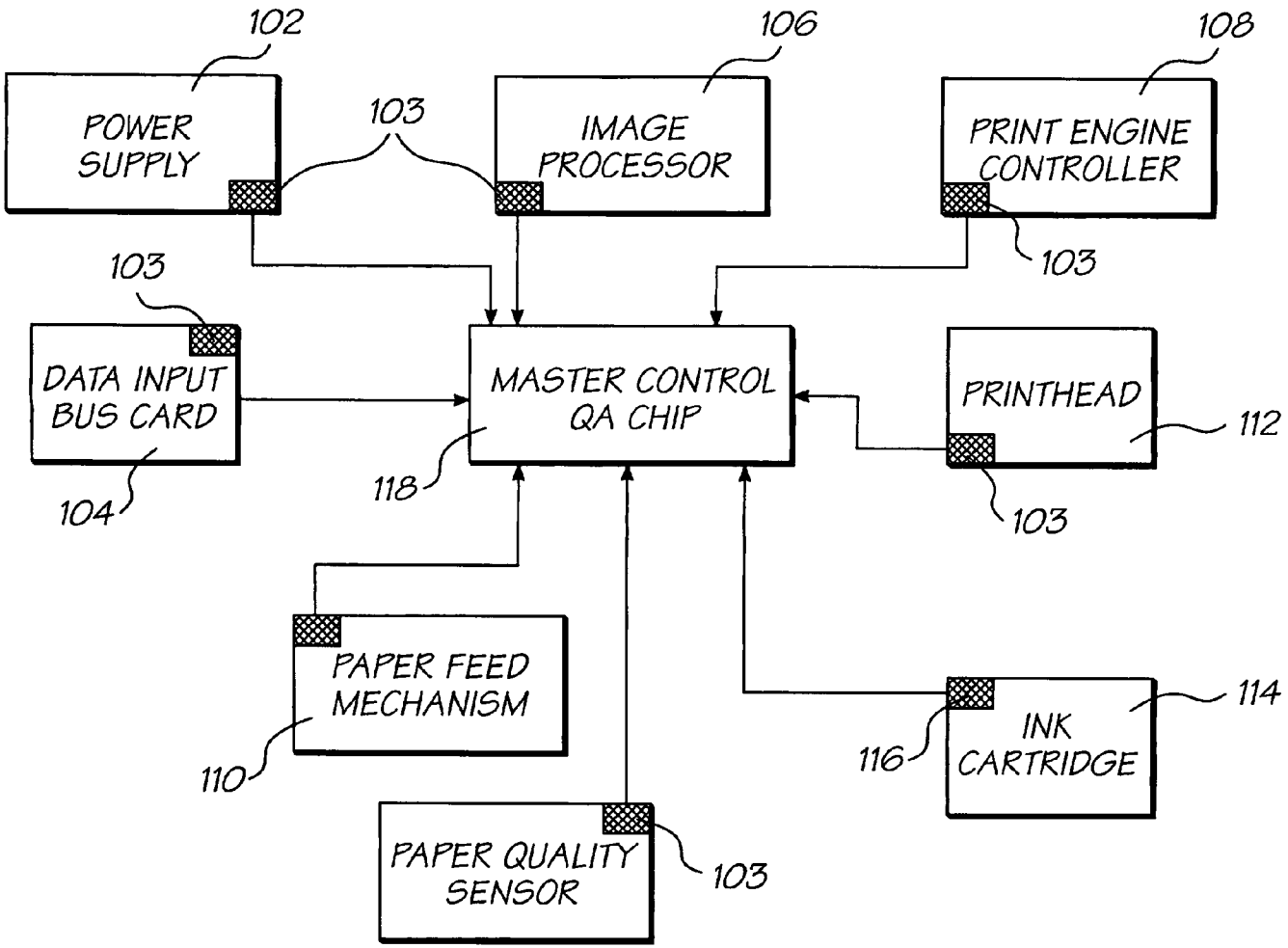
FIG. 2 schematically shows the electronics connection of the various components of the printer of FIG. 1.

Referring to FIGS. 1 and 2 there are shown the major components of an inkjet printer 100. Typically an inkjet printer 100 has a power supply 102, a data input bus 104, an image processor 106, a print engine controller 108, a paper feed mechanism 110, a printhead 112 and ink cartridge 114. The power supply 102 may be internal or external of the printer 100 and the printhead 112 and ink cartridge 114 may be separate units or combined in a single unit.

The performance of an ink jet printer is limited by a number of factors, including:

1) Image processor speed;
2) Data input bus speed;
3) Print engine controller speed;
4) Power supply;
5) Paper feed mechanism speed;
6) Printhead speed.

The printhead firing speed in turn is limited by:

1) Power consumption;
2) Heat dissipation;
3) Ink nozzle refill time;
4) Heat capacity of ink used.

The ink nozzle refill time is in turn limited by:

1) Ink viscosity;
2) Surface tension;
3) Passage/nozzle dimensions.

Assume for the purpose of explaining the invention that all of the electrical and mechanical components of the printer are capable of printing at 20 pages per minute but that the ink used limits the speed to 4 pages per minute. In the prior art, the printer would be hard wired to always run at 4 pages per minute even if the manufacturer subsequently improved the ink. In preferred embodiments of the present invention, each ink cartridge 114 includes a Quality Assurance (QA) chip 116. This QA chip 116 includes read only memory (ROM) or erasable and programmable read only memory (EPROM) which encodes data regarding the cartridge and the ink(s) contained therein. The printer 100 includes a controller unit 118 that manages the operation of the components of the printer. The QA chip 116 of the ink cartridge 114 may communicate with the printer's controller 118 via contacts in the printer's cartridge holder.

The printer's controller unit 118 obtains data from the ink cartridge QA chip 116 regarding the cartridge and its inks and utilizes this to set the print speed of the printer. The data stored in the QA chip 116 may be as simple as data representing 'maximum speed 4 p.p.m.' or it may be data representing physical characteristics of the cartridge or ink or both. Where a cartridge is used for different models and printers, each printer may also have a look up table of printer model and maximum speed encoded in ROM or EPROM. This may be in separate memory or incorporated in the controller unit 118 of each printer.

Different inks or ink cartridges may provide different "speed ratings". An "everyday" ink may only have a speed rating of 4 p.p.m. whilst the manufacturer may have developed a "high performance" ink which has a higher speed rating. Accordingly, when a "everyday" ink cartridge is used, the printer has a maximum speed of 4 p.p.m. but when a "high performance" ink cartridge is used, the printer has a 8 p.p.m. maximum speed.

Accordingly, those consumers who wish to print at higher speeds can easily 'upgrade' their printer merely by using a higher performance rated cartridge, at additional cost, whilst those content with the 'standard' speed need not spend extra on the higher performance ink cartridge. Further, if the manufacturer subsequently develops a 12 p.p.m. ink cartridge, this can be used at this speed.

As shown in FIG. 2 the other components also have their own QA chip 103 which communicates with the master controller 118 and which provide information to the controller 118 as to the performance of the respective component. As with the ink cartridge this data may be provided in different forms. If any component is not replaceable it is not essential that it contain or include its own QA chip for the purposes of the invention. Instead the data relating to the various non-replaceable components may be stored in the QA chip itself or associated memory.

If other components limit the overall speed, they too may be replaced to allow an increase in speed. For example, the image processor of a low-end model may be slower than that of a high-end model of the same family. By providing the image processor in a user replaceable package, the speed of the printer may be easily increased (assuming performance is not limited by other components). The replaceable components may have their own QA device that communicates with the controller or other techniques may be used to determine the "speed rating". In components such as the print engine controller unit and image processor unit, the QA device may be incorporated into the main integrated circuit of the unit or may be provided by way of a separate chip.

The printer may be provided with a number of upgradeable components to provide additional performance. Taking the ink cartridge examples above, the use of a high performance ink cartridge in a low-end printer may result in a printing speed of 8 p.p.m., but the speed may be limited by the image processor rather than the ink. In these circumstances, upgrading the image processor may allow the printer to print at 12 p.p.m. using the high performance ink.

In an alternate form of the invention one of the components that may be replaced is the controller unit itself or that part of the controller unit that includes performance related data. As mentioned above, a manufacturer may make a family of printers that share common components. Market forces allow or require that low performance models be available at low cost and high performance models be available at higher cost. Low-end printers at the bottom of the range may cease to satisfy the customer as the customers requirements change over time. With current practice, if a customer requires improved performance it is necessary to purchase a new printer. This is an additional cost as well as resulting in a redundant printer, which will probably be thrown away or left unused. By providing a printer with components that can all support high-speed printing, the overall performance may be controlled using the controller unit itself to limit print speed or other characteristics, such as resolution. By replacing the control unit itself, the maximum performance of the printer may easily be changed. Alternatively the controller unit maybe fixed in the printer but removable memory modules that store performance related data may be used.

By replacing the controller unit or memory module with a new unit or module, the end user may improve the performance of the original printer. This also allows economies for the manufacturer; a single printer design and a single set of components may support a family of printers, with the only hardware differences being the controller unit, in the programming of the controller unit or memory module installed. By providing a controller unit with EPROM in which the data relating to performance is stored, further savings may be made. A family of printers may share all components with only programming of the control module or provision of memory modules and labeling differentiating models.

This allows 'bare' printers to be shipped to subsidiaries/distributors in different geographic regions with the subsidiary or distributor programming the EPROM of each printer to the necessary performance level. By use of unique ID codes embedded in each controller unit and suitable encryption, unauthorized "upgrading" of the printers (by the distributor or end user) would be prevented.

Figure 3:
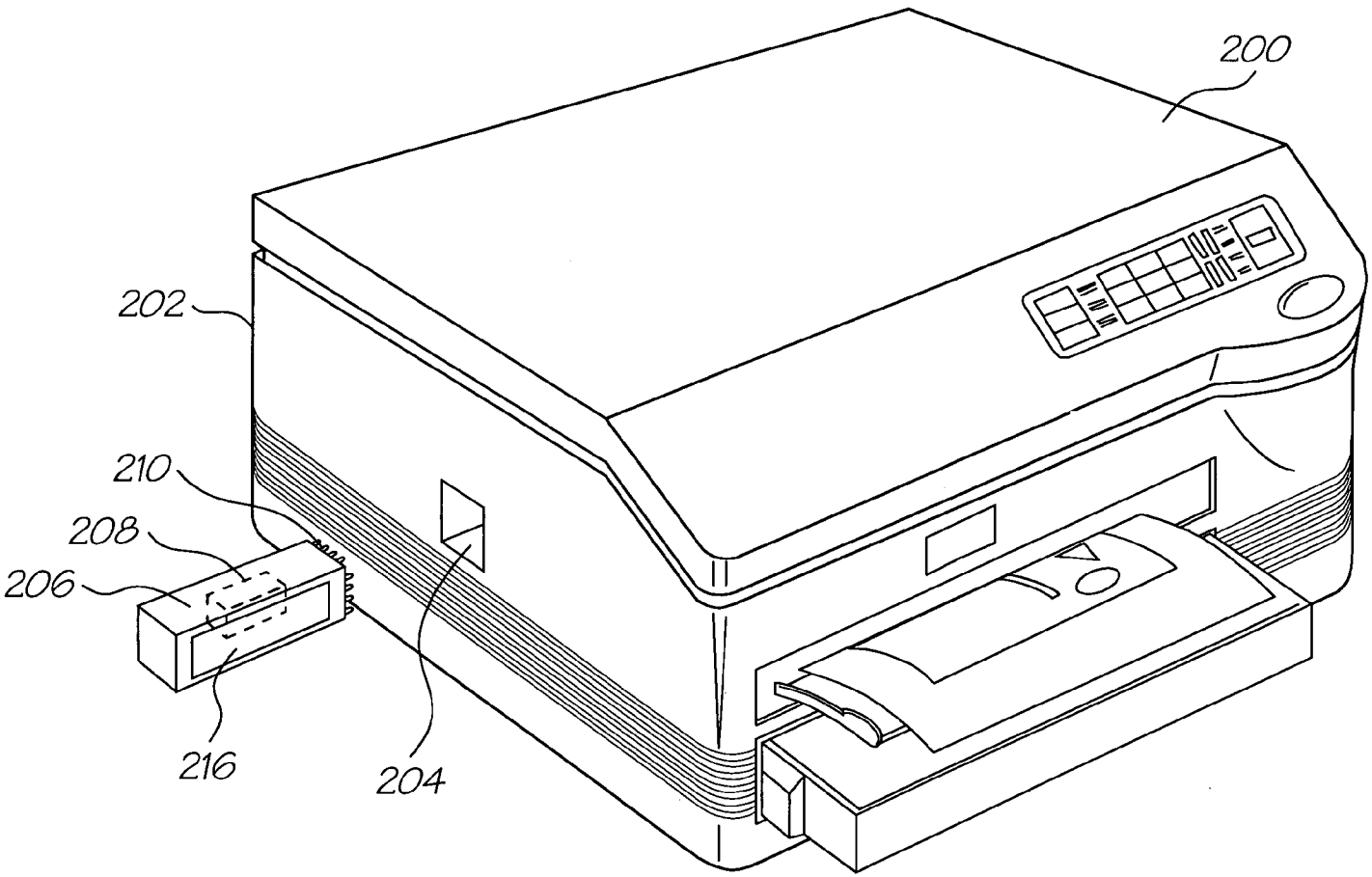
FIG. 3 shows a perspective view of a second embodiment of the invention.

FIG. 3 schematically shows a printer 200 made according to this form of the invention. The printer 200 includes a casing 202 with a socket 204 for receiving a "speed stick" 206, which includes a controller unit 208. The speed stick 206 has terminals 210 that engage corresponding terminals (not shown) in the socket. The design of the terminals is not critical. The controller unit 208 communicates with any QA chips present in the components of the printer in a similar manner to that shown in FIG. 2 and controls the overall performance of the printer. Preferably the speed stick includes a label 216 that provides information as to the performance provided. The speedstick includes data that sets the maximum performance achievable. This data may be incorporated in the control unit 208 or in separate memory in the speed stick. A 'level 1' speedstick may provide a basic print speed of 4 p.p.m. whilst a level 2 speedstick may provide a basic print speed of 6 p.p.m. Preferably the printer will not operate without a speedstick inserted in the socket. If desired the control unit 208 may be incorporated in the printer 200 rather than the speedstick. If the control unit 208 is incorporated in the printer the speedstick may merely include data setting maximum performance levels, together with a QA chip to ensure only authentic speedsticks will operate the printer.

The replaceable speed stick may be used with other replaceable components to obtain different performance. For example, a level 1 ink cartridge in a printer with a level 1 speed stick may provide a print speed of 4 p.p.m. whilst the same ink cartridge in a printer with a level 2 speedstick may provide a print speed of 6 p.p.m. A level 2 ink cartridge may provide print speeds of 8 and 12 p.p.m. with level 1 and 2 speedsticks respectively.

In a similar way to how software manufacturers provide demonstration or 'lite' versions of software for no or minimal cost, a low performance printer may be provided by the manufacturer at no or minimal net profit. The printer is capable of a much higher performance but is artificially limited by the master or controlling QA chip or a replaceable module, such as a speedstick, commensurate with its cost to the end user. In the same way that 'lite' versions of software may be 'unlocked' or converted to the 'full' version, the performance of the printer may be increased by entering a manufacturer/distributor supplied code or password.

The QA chip of the printer or of the module will normally have a unique identification code and this ID code may be used to create one or more passwords for unlocking greater performance. Since the passwords are generated at least partially on the ID code, the password only works with the specific printer or control module that incorporates the ID code.

This system enables the user to incrementally upgrade the performance of the printer by obtaining and paying for appropriate passwords.

Upgrading of performance may be achieved via the Internet or via telephone.

The QA chip includes a unique ID and a random number generator, from which a random number is generated. This random number is used to create an upgrade request code that is transmitted to a manufacturer controlled computer system. The computer system receives the upgrade request code and generates an upgrade code based on the upgrade request code and a secret encoding algorithm. This encoding algorithm is also embedded in the QA chips of each printer or module. After payment has been made the upgrade code is transmitted back to the user or printer. The code is effectively specific to the QA chip which originally sent the upgrade request code as it may only be decoded using the random number originally generated by the QA chip and used to generate the upgrade request code. The random number may be stored in the QA chip indefinitely until an upgrade code is received or may be stored for a preset time and then erased. If the random number is stored indefinitely, every request for an upgrade will result in generation of a new random number so that deciphering of the underlying encryptional with algorithm is more difficult.

Preferably the manufacturer maintains a database such that failure to install an upgrade code can be remedied by merely requesting the upgrade code again.

Where the computer is connected or connectable to the Internet these transactions may occur automatically after initiation by the user and provision of credit/charge card details or similar. Preferably the printer driver application includes an option to upgrade the printer to one or more different print speeds or to upgrade other characteristics.

Figure 4:
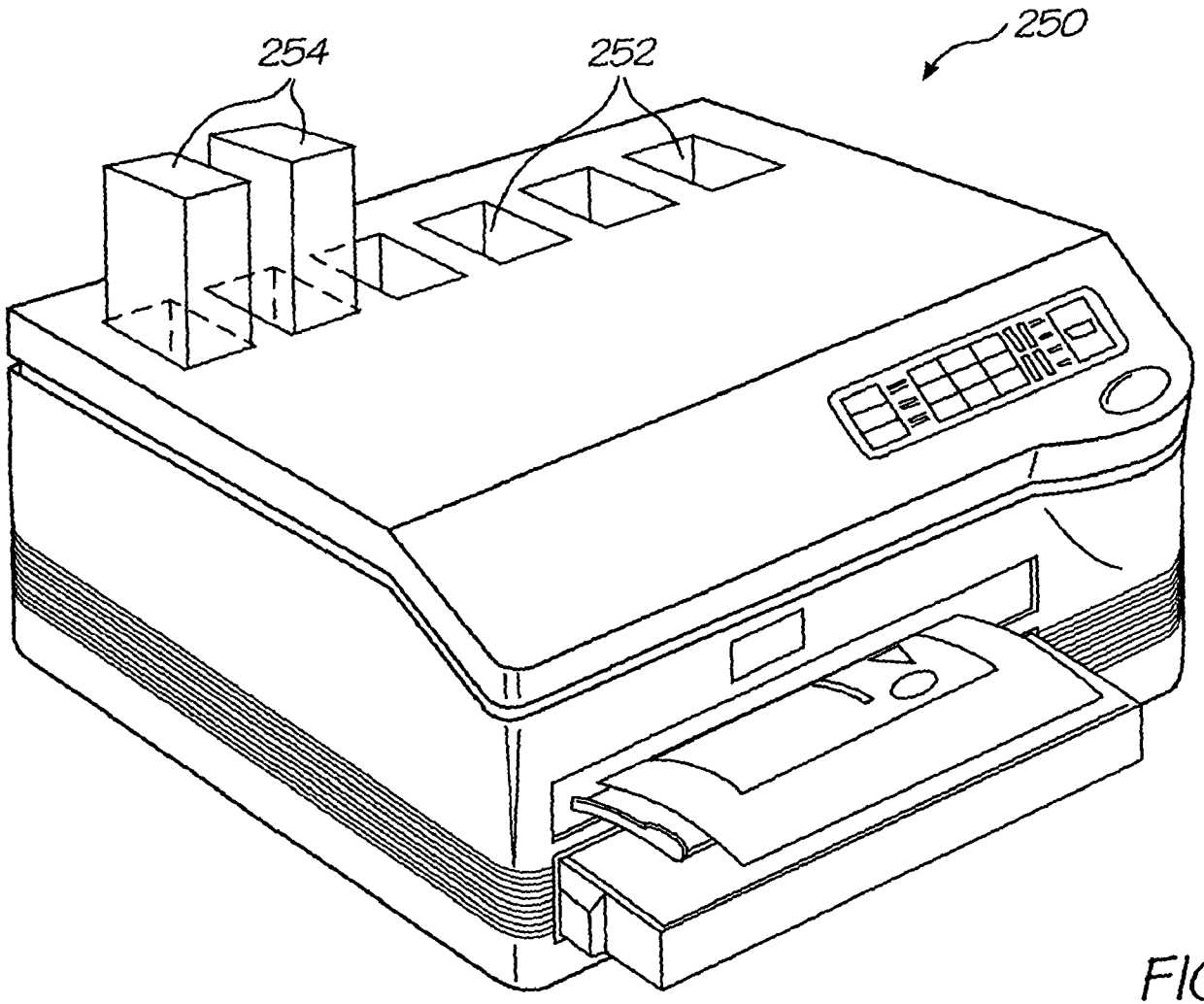
FIG. 4 shows a perspective view of a third embodiment of the invention.

FIG. 4 shows a printer 250 provided with six sockets 252 for six speedsticks 254. Any number of speedsticks may be used and, preferably, these may be inserted in any of the sockets. This allows the printer to be progressively upgraded by adding additional speedsticks at any time. In this embodiment the speed rating of speed sticks is added together, so two single speed sticks will provide twice base speed whilst a 2× and a 10× speed stick together will provide 12× base speed. In the preferred form the printer will not operate without a speedstick. Alternatively the printer may operate at the base speed without a speedstick with a single 1× speedstick providing twice the base speed.

Figure 5:
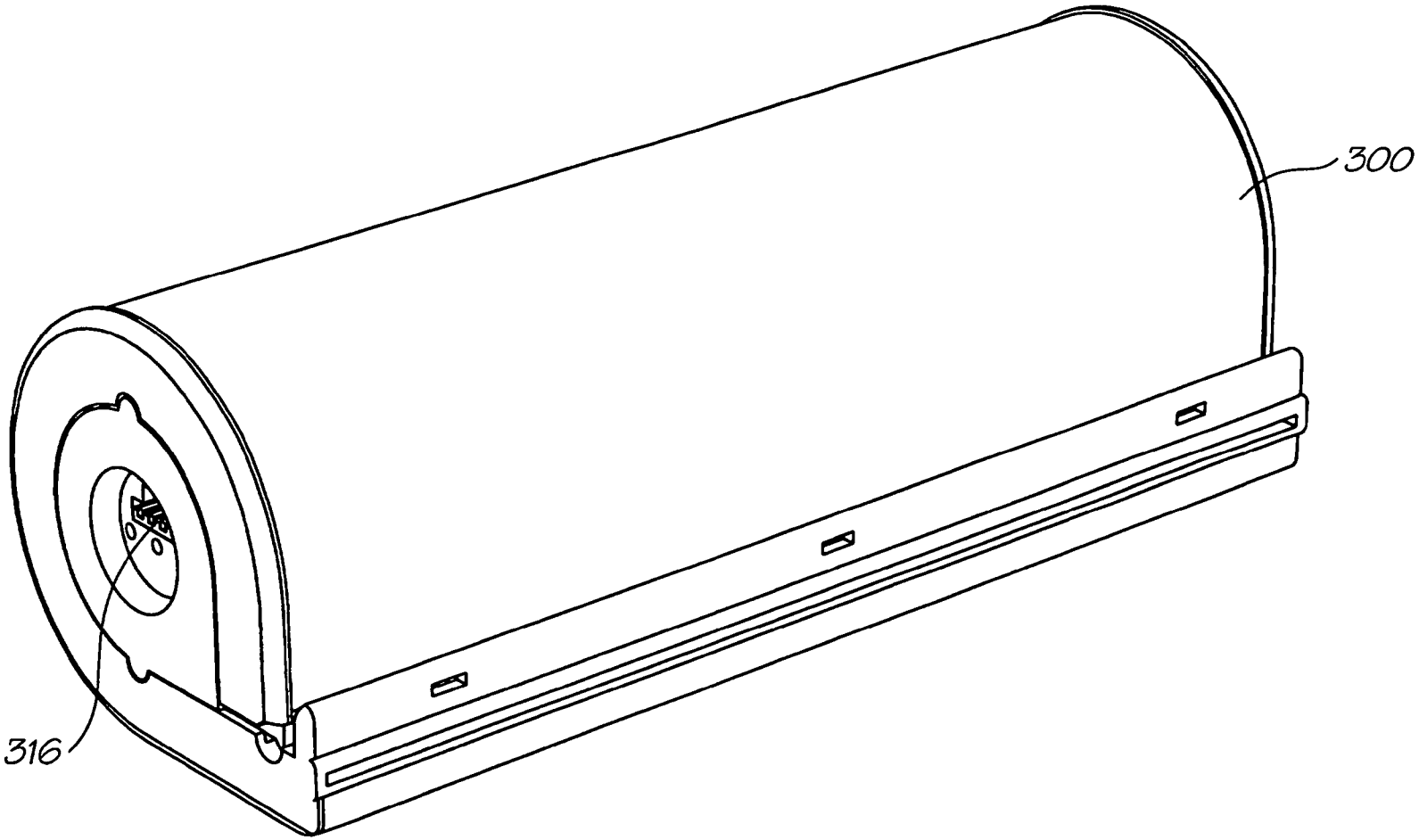
FIG. 5 shows a perspective view of a fourth embodiment of the invention.
Figure 6:
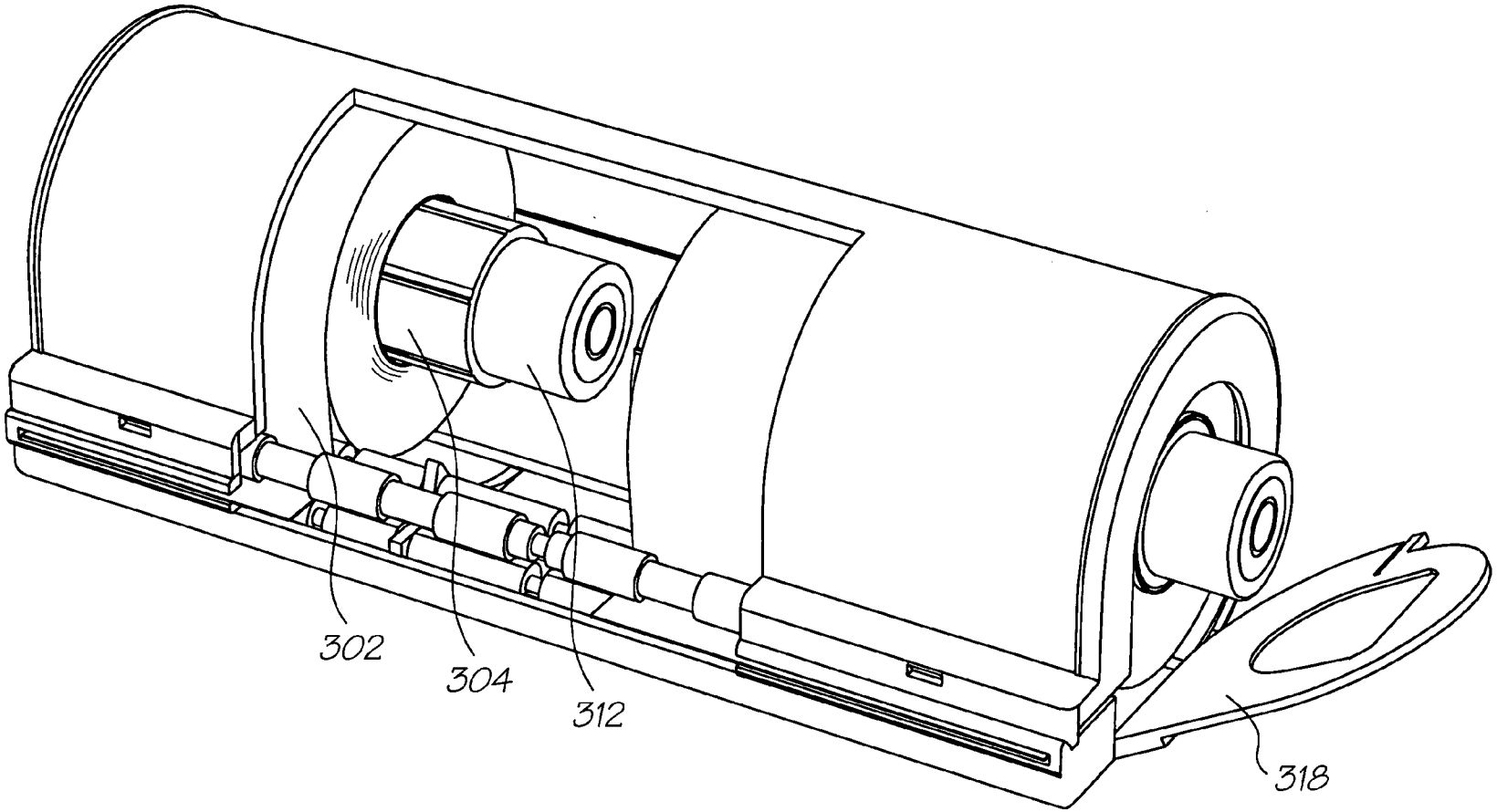
FIG. 6 shows a cut away perspective view of the FIG. 5 embodiment.

FIGS. 5 and 6 show a paper cartridge 300 for a portable printer device, for example a camera with an integrated printer. A camera with printer is disclosed in PCT No. PCT/AU09/00544/US patent Ser. No. 09/113,060 (docket No. ART01US), the contents of which is incorporated herein. The cartridge 300 may contain paper 302 only or it may also contain other supplies, such as ink. The cartridge 300 includes a strip of paper 302 rolled around a central hollow core 304. The paper is cut to length by the printer as it is used.

The printing speed of portable printers is generally limited by the peak power consumption, which must be supplied by batteries, rather than the average power consumption. Peak power consumption usually occurs during printing and higher printing speeds result in higher peak power consumption. Thus print speed is generally limited by the peak power output of the available batteries.

The cartridge 300 includes two batteries 312 in its central core 304. The batteries 312 connect to the printer's battery or batteries via contacts 316 at the end of the cartridge and corresponding terminals (not shown) in the printer. The batteries 312 are connected in parallel to the printer's internal power supply and so provide an increase in peak power output, as well as an increased total capacity. This allows the printer to run at a higher print speed than otherwise.

Detection of a paper cartridge with internal batteries may be achieved by providing the paper cartridge with a QA chip (not shown) or by merely detecting the power source. For example, on insertion of the cartridge 300 into the printer, a self-test routine may be run in which an electrical load is, briefly, placed on the cartridge's batteries 312. By measuring the voltage across the batteries with and without the load, the peak capacity of the batteries may be determined or estimated. Other methods of determining the peak capacity of the batteries may be used. Obviously, a paper cartridge with no batteries or with discharged batteries will be detected by there being a zero voltage across the printers terminals. Testing of the batteries 312 may occur periodically after the cartridge is installed, for instance just before printing, to ascertain if the peak output capacity of the batteries has changed.

The paper cartridge may be a "throw-away" product or a reusable product. If a throw away product, the batteries may be specially made for the cartridge and sealed in place. If the cartridge is reusable as in the FIGS. 5 and 6 embodiment, a cover 318 (see FIG. 6) may be provided for replacement of the batteries, with the batteries themselves being standard sizes, such as AA size.

Use of standard batteries with a user or factory accessible cover allows a single paper cartridge to be provided with different speed ratings. A cartridge with no batteries provides a base speed. A cartridge with 'normal' zinc carbon batteries provides a boost in print speed whilst use of alkaline or other high capacity batteries allows ever faster print speeds.

Figure 7:
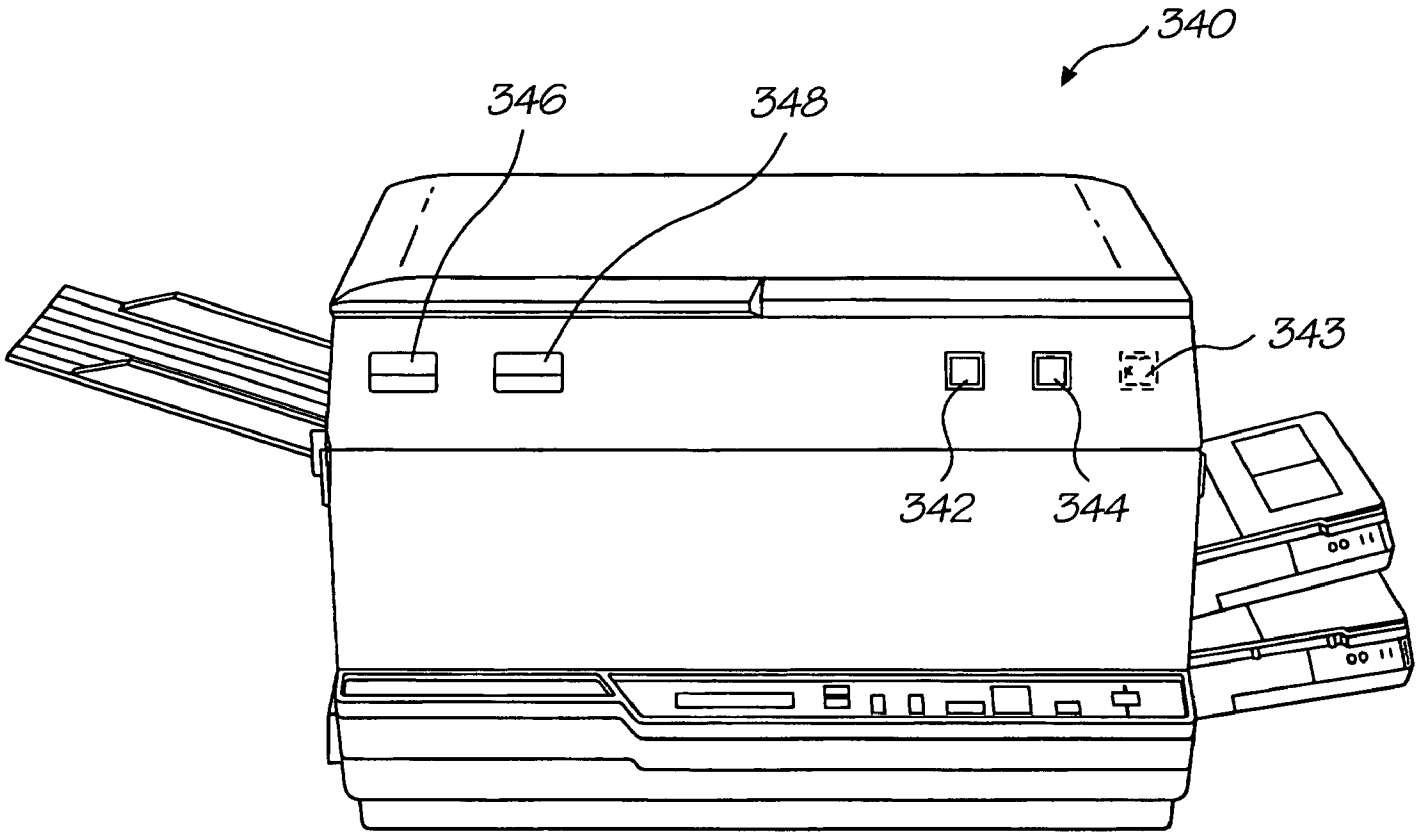
FIG. 7 shows a perspective view of a fifth embodiment of the invention.

FIG. 7 schematically shows a photocopier 340 according to a further embodiment of the invention. The photocopier is preferably a digital photocopier with a pagewidth printhead. Photocopier maintenance is typically charged on a per copy basis. Additionally, higher speeds can, but not necessarily, lead to higher maintenance costs and higher initial capital costs. A customer may not wish to expend the higher capital cost of a higher speed copier. The copier of FIG. 7 is manufactured so as to be capable of high-speed reproduction, for instance 40 copies per minute (cpm), but may be supplied at a cost less than a normal 40 cpm photocopier. The copier has two print buttons 342 and 344. The first button 342 is a 'normal' speed print button whilst the second 344 is a 'high' speed print button. In the embodiment these buttons may equate to speeds of 20 cpm. and 40 cpm. Other forms of speed control may be used including, but not limited to, a rotary dial, a slider, a touch pad and a menu type control. A single copy button 343, shown in dotted outline may be provided with the buttons 342 and 344, or other controls, merely selecting copy speed.

In prior art photocopiers, the copier is provided with a counter, which records copy units, on which basis the maintenance charge is calculated. Typically copying one side of an A4 page or smaller incurs one copy unit charge whilst copying one side of an A3 page incurs two copy unit charges. In the photocopier 340 of the present invention, in normal speed mode, the copier also incurs these base charges when used via base counter 346. The copier 340 is also provided with a second counter 348, which is only incremented when in a higher speed mode. The rate at which the second counter 348 increments is arbitrary, since ultimately the cost to the user is the counter value multiplied by a charge per unit price. The second counter 348 preferably increments at the same rate as the first counter 346, i.e. one unit per A4 copy and two per A3 copy, so that in high speed mode an A4 copy incurs one base unit and one high speed unit. This makes it easier for the customer to see how many 'high speed' copies have been made. The per unit copy charge for the second counter need not have any relationship to the per unit copy charge for the first counter.

The photocopier may be provided with more than two speeds, with higher speeds incurring ever greater overall cost. Whilst separate counters may be used for each speed, there is no reason why a single counter may not be used which is incremented by different amounts depending on the copy speed. Similarly two counters may be provided, one recording base copy charge units and the second recording charge units for higher speed copies. The second counter will increment at different amounts per copy at different copy speeds. The counter(s) may be mechanical or electronic. Additionally the counter may be capable of recording fractions of units. Thus a normal speed copy may incur a charge of one unit, a twice normal speed copy may incur a charge of 1.2 units whilst a quadruple normal speed copy may incur a charge of 1.3 units. It will be appreciated that the exact nature of the counter(s) are not critical to the invention, so long as the charge units per copy are different at different speeds.

Where the photocopier is a color photocopier the copy units may also be based on whether a color or black and white copy was made. Again a separate counter may be provided or a single counter incremented by different amounts depending on the nature of the copy.

Whilst the invention has been described with particular reference to printers and photocopiers devices, it is to be understood that the invention is not limited to printers and photocopiers and has application to any devices.

Range of Applications

The presently disclosed technology is suited to a wide range of printing systems.

Major Example Applications Include:

1. Color and monochrome office printers
2. SOHO printers
3. Home PC printers
4. Network connected color and monochrome printers
5. Departmental printers
6. Photographic printers
7. Printers incorporated into cameras
8. Printers in 3G mobile phones
9. Portable and notebook printers
10. Wide format printers
11. Color and monochrome copiers
12. Color and monochrome facsimile machines
13. Multi-function printers combining print, fax, scan, and copy functions
14. Digital commercial printers
15. Short run digital printers
16. Packaging printers
17. Textile printers
18. Short run digital printers
19. Offset press supplemental printers
20. Low cost scanning printers
21. High speed page width printers
22. Notebook computers with inbuilt page width printers
23. Portable color and monochrome printers
24. Label printers
25. Ticket printers
26. Point-of-sale receipt printers
27. Large format CAD printers
28. Photofinishing printers
29. Video printers
30. PhotoCD printers
31. Wallpaper printers
32. Laminate printers
33. Indoor sign printers
34. Billboard printers
35. Videogame printers
36. Photo 'kiosk' printers
37. Business card printers
38. Greeting card printers
39. Book printers
40. Newspaper printers
41. Magazine printers
42. Forms printers
43. Digital photo album printers
44. Medical printers
45. Automotive printers
46. Pressure sensitive label printers
47. Color proofing printers
48. Fault tolerant commercial printer arrays It will be apparent to those skilled in the art that many obvious modifications and variations may be made to the embodiments described herein without departing from the spirit or scope of the invention.

The invention claimed is:

1. An imaging device for printing onto sheets of media substrate, the imaging device comprising:

a printhead for printing the media substrate;

a controller for operating the printhead at a basic performance setting or an enhanced performance setting;

a user interface for selectively instructing the controller to operate the printhead at the basic performance setting or the enhanced performance setting;

a first meter for keeping a cumulative total of media sheets printed by the printhead at the basic performance setting; and, a second meter for keeping a cumulative total of media sheets printed by the printhead at the enhanced performance setting; such that, a usage profile relating to the sheets printed at the basic performance setting and the sheets printed at the enhanced performance setting, is derived from the first meter reading and the second meter reading.

2. An imaging device according to claim 1 wherein the printhead has a higher print speed when operating at the enhanced performance setting, relative to its print speed when operating at the basic performance setting.

3. An imaging device according to claim 1 wherein the printhead has a higher print resolution when operating at the enhanced performance setting, relative to its print resolution when operating at the basic performance setting.

4. An imaging device according to claim 1 wherein the imaging device is a photocopier.

5. An image device according to claim 1 wherein the imaging device is a printer.

6. An image device according to claim 1 wherein the cumulative totals recorded by the first and second meters respectively are used to determine the charges for regular maintenance such that the media sheets printed by the printhead at the enhanced performance setting incur a higher charge.

* * * * *